US008376452B2

(12) United States Patent
Klasfauseweh et al.

(10) Patent No.: US 8,376,452 B2
(45) Date of Patent: Feb. 19, 2013

(54) ARMOR STEEL STRUCTURE

(75) Inventors: Udo Klasfauseweh, Gütersloh (DE); Andreas Ruwe, Bad Essen (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 20 days.

(21) Appl. No.: 12/947,386

(22) Filed: Nov. 16, 2010

(65) Prior Publication Data

US 2011/0283874 A1 Nov. 24, 2011

(30) Foreign Application Priority Data

Nov. 17, 2009 (DE) ..... 10 2009 053 349

(51) Int. Cl.
*F41H 5/02* (2006.01)

(52) U.S. Cl. ..... 296/187.07; 89/36.02

(58) Field of Classification Search ..... 296/187.07; 89/36.02, 36.05, 903, 930
See application file for complete search history.

(56) References Cited

U.S. PATENT DOCUMENTS

| | | | | |
|---|---|---|---|---|
| 860,378 | A * | 7/1907 | Hibbard | 114/10 |
| 3,724,149 | A * | 4/1973 | Detman | 52/22 |
| 3,724,323 | A * | 4/1973 | Selle | 89/36.14 |
| 4,389,947 | A * | 6/1983 | King et al. | 109/1 S |
| 4,957,034 | A * | 9/1990 | Tasdemiroglu | 89/36.02 |
| 6,282,842 | B1 * | 9/2001 | Simens | 52/2.11 |
| 6,327,954 | B1 * | 12/2001 | Medlin | 89/36.08 |
| 6,405,630 | B1 * | 6/2002 | Gonzalez | 89/36.02 |
| 6,408,733 | B1 * | 6/2002 | Perciballi | 89/36.02 |
| 6,532,877 | B1 * | 3/2003 | Hepburn et al. | 105/404 |
| 6,912,944 | B2 * | 7/2005 | Lucuta et al. | 89/36.02 |
| 7,150,217 | B2 * | 12/2006 | Kershaw | 89/36.05 |
| 7,322,267 | B1 * | 1/2008 | Munson, Jr. | 89/36.02 |
| 7,540,228 | B1 * | 6/2009 | Cronin et al. | 89/36.02 |
| 7,562,612 | B2 * | 7/2009 | Lucuta et al. | 89/36.02 |
| 7,993,716 | B2 * | 8/2011 | Marissen | 428/36.3 |
| 2004/0094026 | A1 * | 5/2004 | Efim et al. | 89/36.02 |
| 2005/0066805 | A1 * | 3/2005 | Park et al. | 89/36.02 |
| 2005/0087064 | A1 * | 4/2005 | Cohen | 89/36.04 |
| 2006/0060077 | A1 * | 3/2006 | Lucuta et al. | 89/36.02 |
| 2006/0065111 | A1 * | 3/2006 | Henry | 89/36.02 |
| 2007/0089597 | A1 * | 4/2007 | Ma | 89/36.02 |

FOREIGN PATENT DOCUMENTS

| | | | |
|---|---|---|---|
| CN | 101025350 | A * | 8/2007 |
| DE | 2853357 | A * | 6/1980 |
| DE | 102007005301 | A1 * | 8/2008 |
| FR | 2867740 | A1 * | 9/2005 |

* cited by examiner

*Primary Examiner* — H Gutman
(74) *Attorney, Agent, or Firm* — Henry M. Feiereisen LLC

(57) ABSTRACT

A three-dimensional structure for armoring a motor vehicle is made of a steel plate and has a substantial hemispherical shape. The structure is reinforced by bending edges having an X-shaped configuration extending over the entire surface of the structure. Arranged between the legs of the X-shaped portion are sections which have surface areas between the legs of the X-shaped portion. The surface area of the X-shaped portion has a generally concave curvature, whereas the surface areas of the sections 11 have convex configurations in relation to the concave surface area of the X-shaped portion.

9 Claims, 3 Drawing Sheets

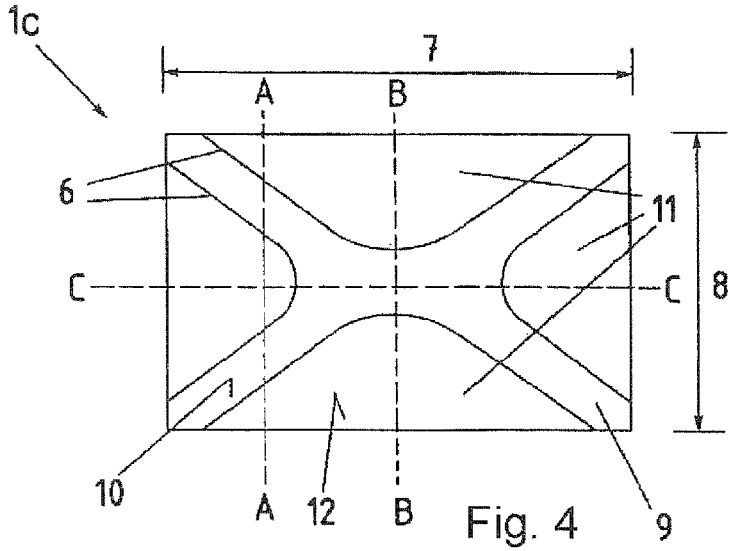
Fig. 4
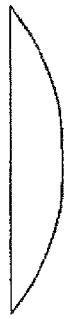
Fig. 4b
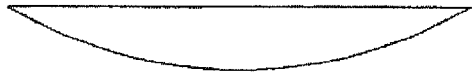
Fig. 4a
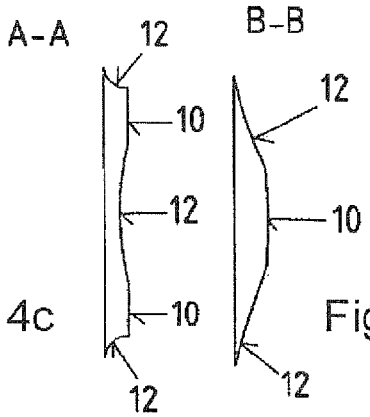
Fig. 4c
Fig. 4d
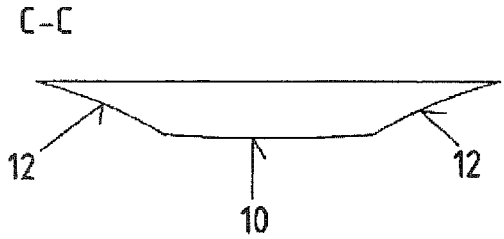
Fig. 4e

ARMOR STEEL STRUCTURE

CROSS-REFERENCES TO RELATED APPLICATIONS

This application claims the priority of German Patent Application, Serial No. 10 2009 053 349.4-15, filed Nov. 17, 2009, pursuant to 35 U.S.C. 119(a)-(d), the content of which is incorporated herein by reference in its entirety as if fully set forth herein.

BACKGROUND OF THE INVENTION

The present invention relates to a three-dimensional structure for armoring a motor vehicle.

The following discussion of related art is provided to assist the reader in understanding the advantages of the invention, and is not to be construed as an admission that this related art is prior art to this invention.

Motor vehicles can be provided with an armor to protect the vehicle from ordnances such as projectiles or explosives. The armor is typically made of steel, in particular armor steel alloys. Armor steel alloys are low-alloy heat-treatable steel of high hardness. Existing motor vehicles can be retrofitted with added armor that can be attached in the interior or to the outer body casing. Newly manufactured and designed vehicles can already have armor-plating integrated therein, e.g. in gaps of the vehicle body or on the outer casing of the vehicle body.

Armoring made of steel alloy is very heavy especially when a high armoring classification is wanted. This weight significantly increases the overall weight of the vehicle. Weight-saving is however important when, for example, combat vehicles or vehicles for particular operations are involved. Also, when air transportability of combat vehicles is an issue, the vehicle weight should be kept to a minimum so as not to exceed the permissible load capacity for transport by aircraft or helicopter.

Increasingly, the demands on armor for a vehicle for better protection of an occupant become more stringent because of the advent of newly developed hard ammunition types and the threat posed by explosives, e.g. booby traps in the form of IEDs (Improvised Explosive Device).

It would therefore be desirable and advantageous to provide an improved armor for vehicles to obviate prior art shortcomings.

SUMMARY OF THE INVENTION

According to one aspect of the present invention, a three-dimensional structure for armoring a motor vehicle is made of a steel plate and has a substantial hemispherical shape.

According to another aspect of the present invention, a motor vehicle includes a vehicle body, and a structure made of a steel plate and having a substantial hemispherical shape, with the structure forming a component of the vehicle body.

The present invention resolves prior art problems by providing a structure of substantial hemispherical shape. As a result, the structure, as used as armor, is able to provide better protection against combat weaponry while having relatively little own weight and to enable a modular configuration of the armor. The term "hemispherical" as used in this disclosure relates essentially to a shape of an elliptical section, with a concave curvature extending over a major part of the entire structure. As a result, the statistic, ballistic performance of an armored vehicle is increased and an impact of a hard ammunition at a right angle)(90° that is detrimental when considering ballistic protection is substantially avoided by the hemispherical curvature. Shooting with a rapid fire gun has thus, on average, significantly more obliquely striking projectiles so that hard ammunitions impact on the surface of an armor structure at an angle of less than 90°. Thus, not only is the presence of obliquely striking projectiles markedly increased but the overall protective effect against hard ammunition is greatly improved compared to a flat armor structure, when the plate thickness is the same.

The protective effect can also be improved when the structure is able to withstand greater compressive loads. This can be achieved by providing the structure with an outwardly directed concave surface. A flat armor structure can shift into the interior when exposed to a shock wave. As a consequence of a substantially hemispherical surface configuration of the armor structure for the motor vehicle, a bulging of the armor structure into the interior of the vehicle is shifted to a higher pressure level. Overall the protective effect is thus enhanced for vehicle occupants.

According to another advantageous feature of the present invention, the structure may be made of armor steel alloy. Armor steel alloys are known to provide protection against ballistic as well as explosive ordnance impact. Suitably, the armor steel alloy may contain alloying components such as carbon, silicon, manganese, aluminum, copper, chromium, nickel, molybdenum, boron, and/or tungsten. The hardening capability of the armor steel alloy can be improved by the elements such as, e.g. manganese, molybdenum, and chromium. A high hardness may be realized by the elements carbon, silicon, and tungsten. In particular tungsten forms very hard carbides and increases the tensile strength, yield point, and toughness of the armor steel alloy. In addition, the armor steel alloy contains a residue of iron and impurities resulting from smelting.

According to another advantageous feature of the present invention, the structure may be made by hot forming and/or press hardening. The process of manufacturing a armor structure for a motor vehicle involves heating a steel plate of non-hardened armor steel with a thickness of about 5 mm to 150 mm to a temperature above the $Ac_3$ point of the alloy before undergoing final shaping. The structure, heated above $Ac_3$, is then shaped in a press tool to its final configuration and at the same time hardened while remaining in the press tool. The structure is thus installed in the absence of a further forming step into the vehicle for armoring purposes. The forming step relates hereby to an active shaping, using for example deep-drawing, bending, or compression molding. Optionally, the finished structure may be trimmed along the edges or several structures may be separated after undergoing the hardening process. These steps may, of course, be eliminated, when cutting the steel plate to size beforehand.

According to another advantageous feature of the present invention, the armor steel structure may include a reinforcement so as to provide additional stiffness and better protection. The provision of a reinforcement to further stiffen the structure does not add much cost and does not adversely affect the structure quality. Also the weight increase is only minimal while the resistance to withstand compressive loads is increased. The reinforcement may be made in the form of bending edges in the structure itself. It is, of course, also conceivable to provide the structure with embossments, using a forming process.

According to another advantageous feature of the present invention, the reinforcement can be a component separate from the structure and coupled therewith. The reinforcement may, for example, be formed on an inner side of the structure. As a result, it is possible to manufacture the reinforcement of a material which is different than the material of the structure itself. The weight of the reinforcement can thus be best suited to the situation at hand when attaching the reinforcement to the inside of the structure being manufactured.

As described above, the reinforcement may be made in the form of bending edges in the structure itself. This can be realized, for example, by a press hardening process by which the reinforcement is manufactured directly in the structure. As a result, forming of the structure can be optimized as far as protection and own weight are concerned. The integrity of the structure after shaping the hemispherical surface is not adversely affected when integrating the reinforcement. Attachment of a separate reinforcement that is secured to the structure through bonding or welding would likely change the texture of the structure.

According to another advantageous feature of the present invention, the bending edges can be sized to extend substantially along an entire length and/or width of the structure. As a result, the bending strength of the structure as well as its overall stiffness, for example in the marginal regions, is enhanced.

According to another advantageous feature of the present invention, the bending edges may extend in longitudinal and/or transverse direction of the structure. As a result of the created geometric reinforcement formation, the structure becomes especially rigid to resist compressive loads from different directions.

According to another advantageous feature of the present invention, the bending edges may be configured to define an X-shaped portion across the entire structure. The X-shaped portion has especially high resistance against compressive load. Moreover, the X-shaped portion enables a substantial hemispherical surface profile over the entire structure while at the same time exhibiting high stiffness, effected by the bending edges.

According to another advantageous feature of the present invention, the X-shaped portion may have a surface with concave curvature. In this way, the X-shaped portion forms an essential part of the hemispherical curvature of the structure. The presence of the X-shaped portion divides the structure into four sections having surfaces with convex curvature. A benefit of this configuration is the interaction of concave and convex surfaces to further increase stiffness of the structure.

The structure according to the present invention may form a component of a motor vehicle door. The geometric shape and the high resistance against compressive load render the armor steel structure especially useful for integration on an inner side, e.g. as an interior panel in a vehicle door, or for formation of an end plate on an outer side. The edge stiffness on the outer circumferential end edge of the structure, which represents a weak point in armored vehicles, can be increased.

According to another advantageous feature of the present invention, the structure may have a curvature which is directed to the outside in relation to a vehicle interior. As a result of the substantial hemispherical surface of the armor steel structure, a section modulus against a compressive load acting from outside on the vehicle interior, is increased.

BRIEF DESCRIPTION OF THE DRAWING

Other features and advantages of the present invention will be more readily apparent upon reading the following description of currently preferred exemplified embodiments of the invention with reference to the accompanying drawing, in which:

FIG. 4 is a schematic plan view of a fourth embodiment of structure according to the present invention;

FIG. 4*a* is a side view of the structure of FIG. 4 along a length thereof;

FIG. 4*b* is a side view of the structure of FIG. 4 along a width thereof;

FIG. 4*c* is a section of the of the structure of FIG. 4, taken along a line A-A in FIG. 4;

FIG. 4*d* is a section of the of the structure of FIG. 4, taken along a line B-B in FIG. 4; and FIG. 4*e* is a section of the of the structure of FIG. 4, taken along a line C-C in FIG. 4.

DETAILED DESCRIPTION OF PREFERRED EMBODIMENTS

Figure 1:
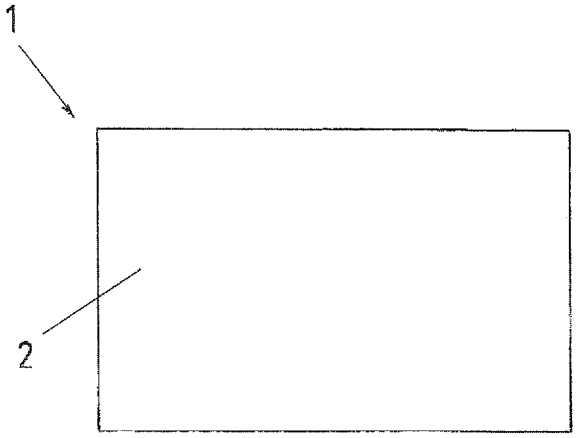
FIG. 1 is a schematic plan view of a first embodiment of structure according to the present invention.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Figure 1B:
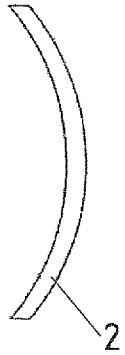
FIG. 1*b* is a side view of the structure along a width thereof.
Figure 1A:
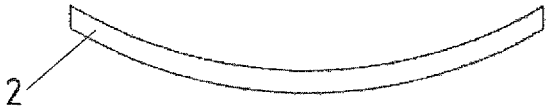
FIG. 1*a* is a side view of the structure along a length thereof.

Turning now to the drawing, and in particular to FIGS. 1, 1*a*, 1*b*, there are shown plan and side views of a first embodiment of a structure according to the present invention, generally designated by reference numeral 1 and made from a steel plate 2. The steel used for the steel plate 2 is an armor steel alloy containing elements selected from the group consisting of carbon, silicon, manganese, aluminum, copper, chromium, nickel, molybdenum, boron, tungsten, and combinations thereof. As best seen from FIGS. 1*a* and 1*b*, showing side views of the structure 1 along the length and width, respectively, the structure 1 has a substantial hemispherical configuration.

Figure 2:
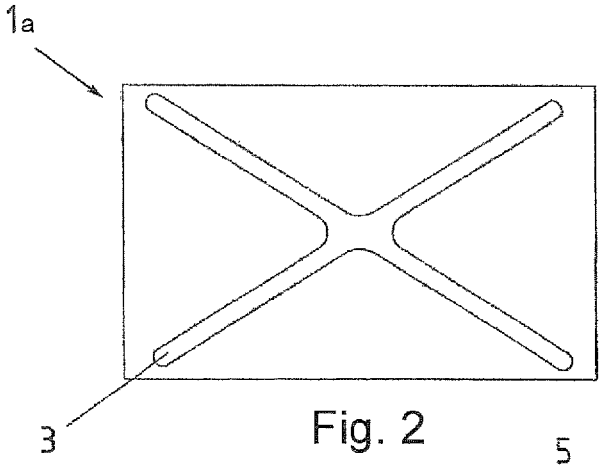
FIG. 2 is a schematic plan view of a second embodiment of a structure according to the present invention, provided with a first variation of a reinforcement.
Figure 2B:
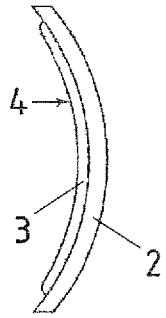
FIG. 2*b* is a side view of the structure of FIG. 2 along a width thereof.
Figure 2A:
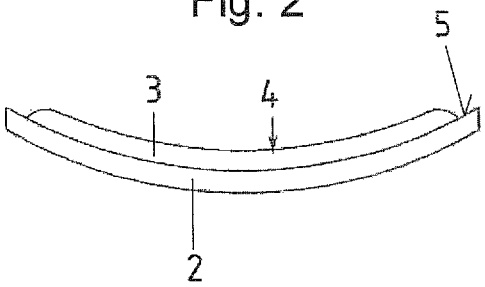
FIG. 2*a* is a side view of the structure of FIG. 2 along a length thereof.

FIGS. 2, 2*a*, 2*b* show plan and side views of a second embodiment of a structure according to the present invention, generally designated by reference numeral 1*a*. Parts corresponding with those in FIG. 1 are denoted by identical reference numerals and not explained again. The description below will center on the differences between the embodiments. In this embodiment, provision is made for a reinforcement 3 which is manufactured as a separate component 4 and coupled with the structure 1*a* on the form of a hemispherical steel plate 2. The reinforcement 3 is hereby arranged in an inner side 5 of the steel plate 2. As shown in FIG. 2*a*, the reinforcement 3 has a substantial X-shaped configuration.

Figure 3:
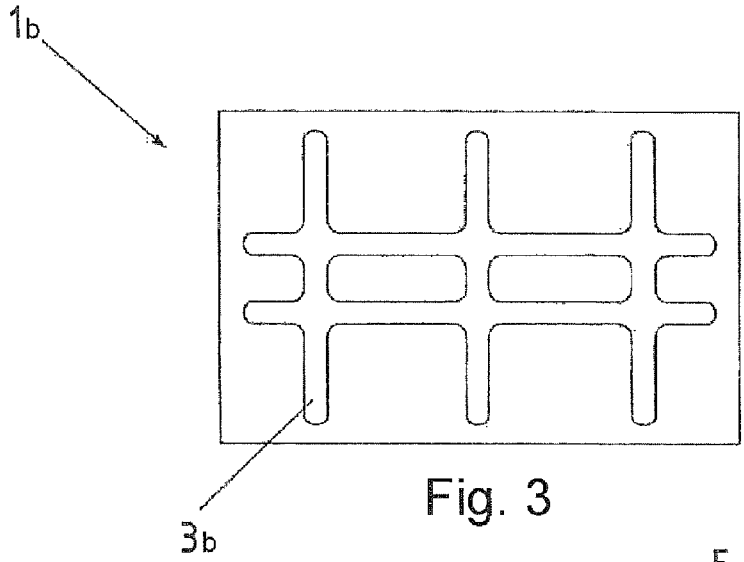
FIG. 3 is a schematic plan view of a third embodiment of a structure according to the present invention, provided with a second variation of a reinforcement.
Figure 3B:
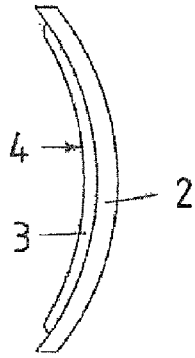
FIG. 3*b* is a side view of the structure of FIG. 3 along a width thereof.
Figure 3A:
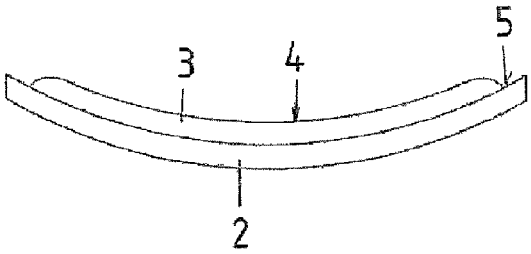
FIG. 3*a* is a side view of the structure of FIG. 3 along a length thereof.

FIGS. 3, 3*a*, 3*b* show plan and side views of a third embodiment of a structure according to the present invention, generally designated by reference numeral 1*b*. Parts corresponding with those in FIG. 2 are denoted by identical reference numerals and not explained again. The description below will center on the differences between the embodiments. In this embodiment, provision is made for a reinforcement 3*b* which has a grid-like configuration with horizontally and vertically extending sections.

FIGS. 4, 4*a*, 4*b* show various views of a fourth embodiment of a structure according to the present invention, generally designated by reference numeral 1*c*. Parts corresponding with those in FIG. 2 are again denoted by identical reference numerals and not explained again. The description below will center on the differences between the embodiments. In this embodiment, the structure 1*c* is made from a steel plate 2 through a hot forming process and includes a reinforcement configured as bending edges 6 which extend over an entire length 7 and entire width 8 of the structure 1*c*. The reinforcement is hereby configured to form an X-shaped portion 9 over the entire structure 1*c*. The X-shaped portion 9 has a surface area 10 which essentially forms the X-shape, when viewed from atop, as shown in FIG. 4.

Arranged between the legs of the X-shaped portion 9 are sections 11 which have surface areas 12 between the legs of the X-shaped portion 9. The surface area 10 of the X-shaped portion 9 has a generally concave curvature, whereas the surface areas 12 of the sections 11 have convex configurations in relation to the concave surface area 10. This is shown in more detail in FIGS. 4*c*, 4*d*, 4*e* which show various sectional views of the X-shaped portion 9, taken along the lines A-A, B-B, and C-C in FIG. 4, respectively, to illustrate the surface area 10 of the X-shaped portion 9 and the surface areas 12 of the sections 11.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A three-dimensional structure for armoring a motor vehicle, said structure being made of a steel plate by hot forming and press hardening, said steel plate being made of armor steel alloy and having a substantial hemispherical shape, said structure including a reinforcement made in the form of bending edges in the structure itself.

2. The structure of claim 1, wherein the armor steel alloy includes at least one element selected from the group consisting of carbon, silicon, manganese, aluminum, copper, chromium, nickel, molybdenum, boron, tungsten, and combinations thereof.

3. The structure of claim 1, wherein the reinforcement is formed on an inner side of the structure.

4. The structure of claim 1, wherein the bending edges are sized to extend substantially along at least one of an entire length and entire width of the structure.

5. The structure of claim 1, wherein the bending edges extend in at least one of a longitudinal direction and transverse direction of the structure.

6. The structure of claim 1, wherein the bending edges are configured to define an X-shaped portion across the entire structure.

7. The structure of claim 6, wherein the X-shaped portion has a surface area with concave curvature.

8. The structure of claim 6, comprising four sections formed between the X-shaped portion and an outer circumferential edge, said sections having surface areas with convex curvature.

9. A motor vehicle door, comprising:

a door frame; and a structure forming an interior panel of the door frame and being made of a steel plate by hot forming and press hardening, said steel plate being made of armor steel alloy and having a substantial hemispherical shape, said structure including a reinforcement made in the form of bending edges in the structure itself.

* * * * *